United States Patent [19]

Morelli

[11] Patent Number: 4,659,260

[45] Date of Patent: Apr. 21, 1987

[54] TRENCH BOX

[76] Inventor: Aldo Morelli, 25 Rockwood Ter., Jamaica Plain, Mass. 02130

[21] Appl. No.: 855,327

[22] Filed: Apr. 24, 1986

[51] Int. Cl.[4] ..... E21D 5/00

[52] U.S. Cl. ..... 405/283; 405/272

[58] Field of Search ..... 405/283, 150, 151, 152, 405/153, 282

[56] References Cited

U.S. PATENT DOCUMENTS 2,865,178 12/1958 Wicke ..... 405/283

3,750,409 8/1973 Orfei ..... 405/283

*Primary Examiner*—Dennis L. Taylor

*Attorney, Agent, or Firm*—Robert T. Gammons

[57] ABSTRACT

A trench box of the kind comprising spaced, parallel side walls held in spaced, parallel relation by end plates characterized in that the side walls are comprised of relatively light gauge sheet metal, reinforced at the opposed sides by sheet metal ribs and braces such as to prevent buckling of the side walls.

1 Claim, 4 Drawing Figures

TRENCH BOX

BACKGROUND OF THE INVENTION

Trench boxes providing barriers against cave-in are used extensively and, although constructed of heavy gauge material, are subject to failure and can rarely be used more than once. Moreover, because of the heavy gauge sheet material of which they are constructed, they are expensive and difficult to handle. It is the purpose of this invention to provide a trench box of relatively light gauge metal so reinforced as to efficiently resist failure due to lateral pressure. Further objects are to lower the initial cost of the structure, reduce its overall weight so as to enable easier handling and placement and to provide a structure which can be used repeatedly.

SUMMARY OF THE INVENTION

As herein illustrated, the trench box comprises spaced, parallel sheet metal side wall panels disposed at a distance from each other corresponding to substantially the width of the trench, to the inner sides of which are applied reinforcement comprising longitudinally-extending, vertically-spaced, horizontal ribs, one of which is located along the top edge and the other intermediate the top and bottom edges. Between the horizontal ribs, there are disposed longitudinally-spaced, vertical ribs and below the intermediate horizontal rib and the bottom edge, there are longitudinally-spaced, vertical braces. Reinforcing plates are disposed between the vertical ribs and reinforcing plates are disposed between the longitudinally-spaced braces. The sheet metal panels are held in spaced, parallel relation to each other by transverse structures, one at each end, pinned to the vertically-spaced, horizontal ribs.

The invention will now be described in greater detail with reference to the accompanying drawings, wherein:

FIG. 2 is a perspective broken away in part of one side wall of the trench box;

Figure 1:
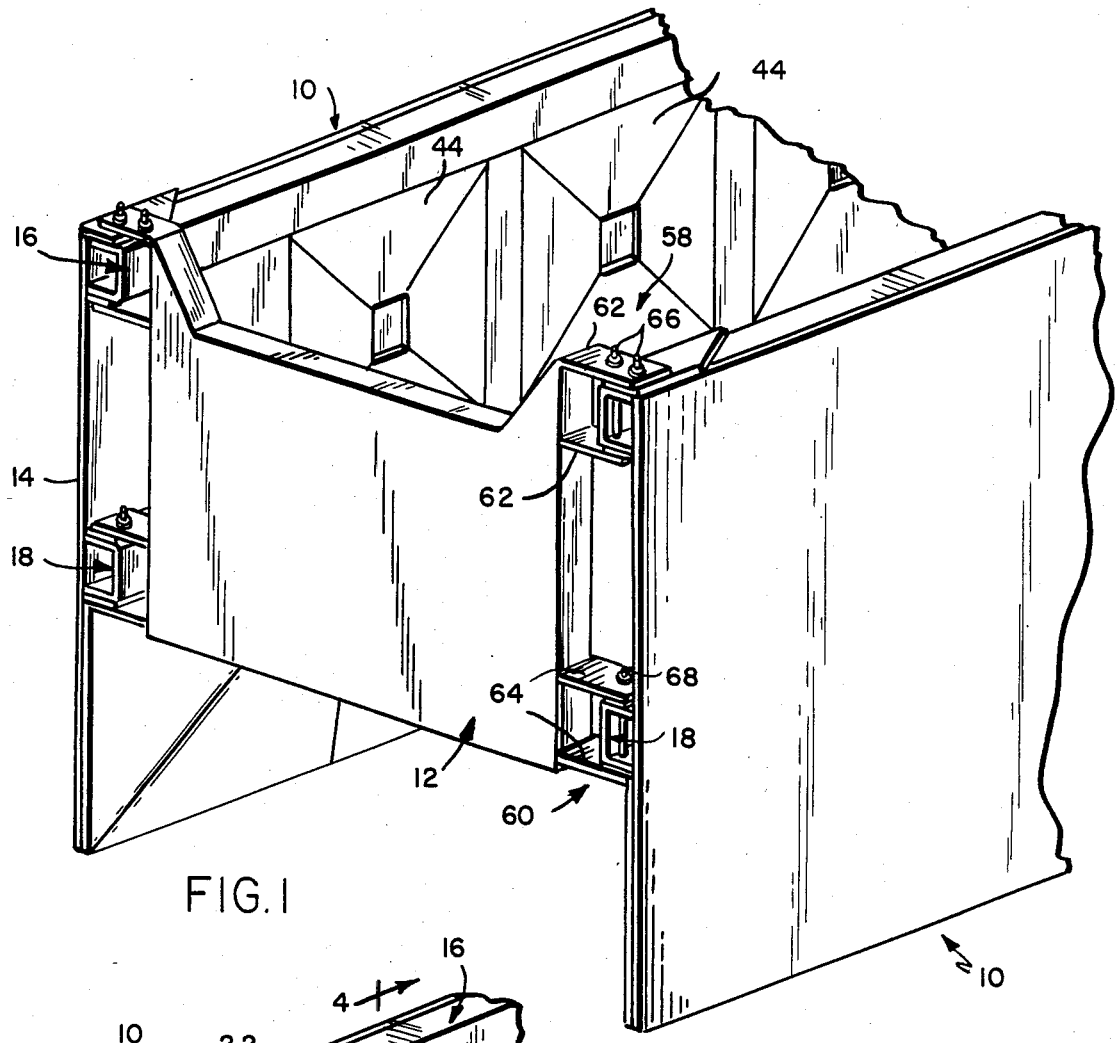
FIG. 1 is a fragmentary perspective of the trench box according to this invention showing an end portion thereof.
Figure 6:
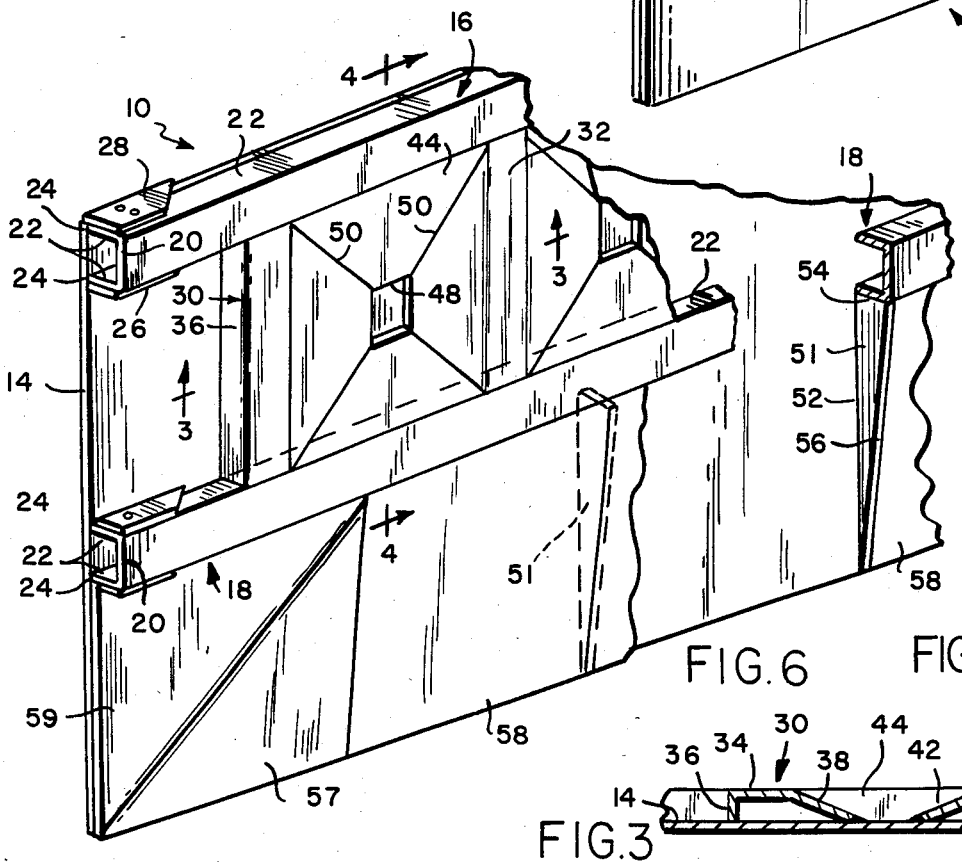

Referring to the drawings, the trench box according to this invention comprises spaced, parallel side walls 10 of generally rectangular configuration held in spaced, parallel relation by transversely-disposed spacers 12, one at each end of the respective ends of the spaced, parallel side walls. Trench boxes are generally 20 feet long from end to end. The improved structure as shown herein enables increasing the length of the trench box to 30 to 40 feet, which materially reduces the handling and emplacement problems and is constructed of light gauge sheet metal and so structured as to afford improve resistance to buckling over such prior art trench boxes as are known without adding to the cost.

As illustrated, FIG. 2, each side wall 10 is comprised of a rectangular sheet 14 of light gauge metal, to the inner side of which is welded vertically-spaced channel members 16 and 18 which extend throughout the length of the wall from end to end. The channel 16 is located along and parallel to the upper edge of the walls 14 and the channel 18 is welded to the wall in spaced, parallel relation to the upper channel 16 approximately midway between the upper and lower edges. The channels 16 and 18 are of rectangular, U-shaped cross section. each channel 16 and 18 has a flat, rectilinear, vertical web 20 and spaced, parallel, horizontal flanges 22—22. The edges 24—24 of the channels are welded to the inner side of the wall 14. At the opposite ends, the channels are reinforced with vertically-spaced bracket plates 26,28.

Figure 4:
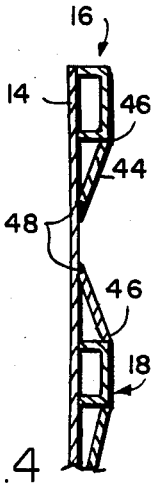
FIG. 4 is a vertical section taken on the line 4—4 of FIG. 2.
Figure 3:
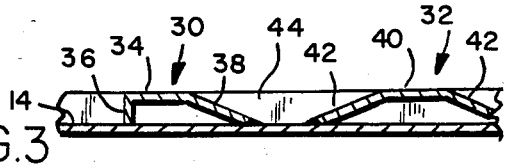
FIG. 3 is a horizontal section taken on the line 3—3 of FIG. 2.

Stiffening means are attached to the inner face of the wall 14 between the channels 16 and 18 and between the channel 18 and the lower edge of the plate 14. The stiffening means are disposed longitudinally of side wall 10 in spaced relation. The stiffening means disposed between the channels 16,18, FIG. 3, comprise vertically-disposed ribs 30 adjacent the opposite ends and intermediate the ribs 30, ribs 32. Each rib 30 extends from the channel 16 to the channel 18 with its ends abutting, respectively, the flange 22 of the channel 16 and the flange 22 of the channel 18 and comprises a web 34, FIG. 3, parallel to the plate 14, a flange 36 perpendicular to the plate 14 and a flange 38 inclined to the plate 14. Each rib 32 extends from the channel 16 to the channel 18 and comprises a web 40 parallel to the plate 14 and two flanges 42—42 inclined to the plate 14. The edges of the flanges 36, 38 and 42 are welded to the plate 14. Intermediate the ribs 30 and 32, there are reinforcing plates 44 of trapezoidal configuration having spaced, parallel edges 46 and 48 and diverging edges 50—50. The edges 46 of the trapezoidal plates 44 as shown in FIG. 4 are welded to the inner sides of the channels 16 and 18 and at 48 to the plate 14. The edges 50—50 are welded to the inclined flanges 38 and 42.

The reinforcement below the rib 18 comprises longitudinally-spaced, parallel, triangular webs 51 disposed with their right sides 52 in engagement with the plate 14, with their bases 54 abutting the underside of the channel 18 and with their inclined sides 56 facing inwardly with respect to the plate 14. Facing plates 58 are welded between pairs of the webs 51 to the inclined edges 56 thereof. At the opposite ends, angularly-disposed face plates 57,59 are employed.

As previously mentioned, the spaced, parallel side walls 10 are supported in spaced, parallel relation by spacers 12. The spacers 12 are structured to provide for rigidity and provided at their opposite ends with vertically-spaced attaching means 60,61 for attachment to the channels 16 and 18. As illustrated, attaching means at the top comprises vertically-spaced, parallel anchor plates 62—62 at the top and vertically-spaced anchor plates 64—64 at the bottom. The anchor plates are spaced apart to receive the channel members 16 and 18 and are detachably connected thereto by anchoring means 66 at the top and 68 at the bottom. To prevent biasing of the side walls 10—10 relative to each other, that is, to hold them squarely with respect to the end members 12, two anchoring means 66—66 are used as the top. Only one anchoring means 68 is required at the bottom.

Desirably, the plate 14 comprising the side walls 10 are ¼ inch sheet steel AR-235 and the reinforcing structure is 836 mild steel.

As thus structured, the side walls 10—10 of the trench box are effectively stiffened without materially increasing the overall weight of the structure to resist the pressures expected to be encountered.

It should be understood that the present disclosure is for the purpose of illustration only and includes all modifications or improvements which fall within the scope of the appended claims.

What is claimed is:

1. A trench box comprising spaced, parallel side wall panels, spaced, parallel channel members secured to the facing sides of said side wall panels throughout their length, one along the top edge and one medially of the top and bottom edges, said channel members being of rectangular cross section, transversely-disposed cross brace panels disposed between the side wall panels at intervals longitudinally of the side wall panels, each cross brace panel being detachably connected by connecting means to the upper and median channel members, said connecting means comprising vertically-spaced flange members embracing the upper and lower sides of the channel members, pins extending through said flanges and the channel members, there being at least two pins extending through the interchanged flanges and channel members at the top to prevent pivotal movement in the side wall panels relative to the cross brace panels and stiffening structure affixed to the facing sides of the side wall panels between the channel members and between the median channel members and the lower edges of the side wall panels comprising angularly-disposed stiffening plates fixed, respective, to the outer sides of the channel members and to the wall panels.

* * * * *